US011116687B2

(12) United States Patent
Hale

(10) Patent No.: US 11,116,687 B2
(45) Date of Patent: Sep. 14, 2021

(54) INTERCHANGEABLE FOOT THERAPY MASSAGER

(71) Applicant: Shawn Hale, Los Angeles, CA (US)

(72) Inventor: Shawn Hale, Los Angeles, CA (US)

( * ) Notice: Subject to any disclaimer, the term of this patent is extended or adjusted under 35 U.S.C. 154(b) by 6 days.

(21) Appl. No.: 16/583,113

(22) Filed: Sep. 25, 2019

(65) Prior Publication Data

US 2020/0093675 A1 Mar. 26, 2020

Related U.S. Application Data

(60) Provisional application No. 62/736,345, filed on Sep. 25, 2018.

(51) Int. Cl.

| | |
|---|---|
| ***A61H 1/00*** | (2006.01) |
| ***A61H 1/02*** | (2006.01) |
| *A43B 7/14* | (2006.01) |

(52) U.S. Cl.

CPC ..... *A61H 1/0266* (2013.01); *A43B 7/142* (2013.01); *A43B 7/1465* (2013.01); *A61H 2205/12* (2013.01)

(58) Field of Classification Search

CPC .. A61H 1/0266; A61H 2205/12; A43B 7/142; A43B 7/1465

See application file for complete search history.

(56) References Cited

U.S. PATENT DOCUMENTS

| | | | | |
|---|---|---|---|---|
| 5,689,902 | A * | 11/1997 | Juang | A43B 21/32 36/141 |
| 6,234,987 | B1 * | 5/2001 | Chen | A43B 7/144 36/141 |
| 6,478,756 | B1 * | 11/2002 | Chen | A47K 7/026 601/134 |
| 2018/0008002 | A1 * | 1/2018 | Yick | A43B 7/1425 |
| 2018/0116902 | A1 * | 5/2018 | Patton | A61H 15/00 |
| 2019/0116922 | A1 * | 4/2019 | Wurtz | A43B 7/142 |

* cited by examiner

*Primary Examiner* — Steven O Douglas

(57) ABSTRACT

An interchangeable foot therapy massager including a base defining a cavity having a first section having a first diameter and a second section having a second diameter greater than the first diameter, an insert including a pair of opposing sides and configured to be received within the first and second sections of the cavity, the insert including a head for contacting the foot of the user, a lip for engaging the second section of the cavity, and defining a space configured to allow for inward flexure, wherein applying force to the sides of the insert causes the insert to flex inwardly, removing force from the sides of the insert causes the insert to flex outwardly, and when the insert flexes outwardly the at least one lip engages the second section of the cavity.

20 Claims, 8 Drawing Sheets

INTERCHANGEABLE FOOT THERAPY MASSAGER

BACKGROUND

The present disclosure relates generally to devices, systems, and/or methods for rehabilitating a foot of a user. More particularly, the present disclosure relates to a ball-shaped insert which can be interchangeably adjusted and/or customized to suit the needs of a user.

A foot injury may include symptoms such as pain, tension, weakness, soreness, stiffness, joint noises, and/or decreased range of motion. The foot injury can often be attributed to an active lifestyle and/or participation in athletic endeavors such as skateboarding, soccer, tennis, basketball, running, walking, and the like. Further, a foot injury may also be attributed to general overuse, poor foot mechanics, weak core muscles, and/or worn-out footwear. The foot injury may typically be due to inflammation involving the bones, muscles, joints, ligaments, tendons, and/or bursas of the foot.

A common recommendation within the field of physical therapy aimed at relieving sore foot and leg muscles includes using a tennis ball, lacrosse ball, or billiards ball to relieve a tight arch within a person's foot. Massaging the arch of the foot lengthens muscle fibers and provides for myofascial release, which soothes and prevents injury. Massaging the arch region of the foot relaxes contracted muscles, stimulates stretch reflex in muscles, and improves blood and lymphatic circulation.

Currently available foot therapy devices, systems, and/or methods (including the commonly recommended ball technique mentioned above) typically require a user to be seated and/or only focusing on the specific foot therapy for effective use. Further, some foot therapy devices, systems, and/or methods are not easily customizable and/or require a user to wear a device without taking it off (which can be harmful to foot muscles). Many foot therapy devices, systems, and/or methods do not allow a user to quickly and efficiently implement the device, system, or method or cease using the device, system, or method. Lastly, many currently available foot therapy devices, systems, and/or methods are difficult to use, non-ergonomic, and/or costly and complex to manufacture.

There is a need for an ergonomic, easily customizable foot therapy device, system, and/or method which provides for use when a user is walking or handling other tasks, allows a user to quickly, effectively, and conveniently begin or end use of the device, system, or method, and is inexpensive and simple to manufacture.

It is desirable to provide an improved interchangeable foot therapy massager in a manner that fulfills one or more of the needs described above.

SUMMARY

According to aspects illustrated herein, the interchangeable foot therapy massager (hereafter, "the massager") is configured to couple and secure interchangeable parts of a therapy device without the use of excess components and/or complex manufacturing. Further, the interchangeability of the components of the massager is designed for ease of use as well as to provide superior functionality and results for the user. Specifically, the massager is capable of coupling one of several inserts within a base such as an insole or a slipper quickly and securely.

The massager is contemplated for use by a user on a walkable surface. The base is configured to position between a foot of the user and the walkable surface beneath the user. The base includes a first surface and a second surface and defines a cavity extending from the first surface toward the second surface. The cavity of the base includes a first section which has a first diameter and a second section which has a second diameter greater than the first diameter of the first section.

The insert has a pair of opposing sides and is configured to be received within the first and second sections of the cavity of the base and to be positioned between the foot of the user and the walkable surface. The insert includes a head for contacting the foot of the user, at least one lip for engaging the second section of the cavity of the base, and defines a space which allows for inward flexure of the insert.

In use, applying force to the sides of the insert causes the insert to flex inwardly and removing force from the sides of the insert causes the insert to flex outwardly. When the insert flexes outwardly the at least one lip engages the second section of the cavity when the insert is received within the first and second sections of the cavity. In this secure position within the first and second sections of the cavity of the base, the head of the insert projects to a position above the first surface of the base.

In this arrangement, the massager provides for an ergonomic, customizable foot therapy device, system, and/or method which allows for use when a user is simultaneously walking or handling other tasks. Further, the massager allows a user to quickly, effectively, and conveniently begin or end use of the device, system, or method, while remaining inexpensive and simple to manufacture without excess components.

According to aspects illustrated herein, a method of making the massager comprises a step of providing a base configured to be positioned between a foot of a user and a walkable surface beneath the user. The base including a first surface and a second surface.

The method further includes a step of defining a cavity extending from the first surface of the base toward the second surface of the base. The cavity includes a first section having a first diameter and second section having a second diameter greater than the first diameter of the first section.

The method also comprises a step of providing an insert having a pair of opposing sides. The insert is configured to be received within the first and second sections of the cavity and positioned between the foot of the user and the walkable surface. The insert includes a head for contacting the foot of the user, a lip for engaging the second section of the cavity, and defines a space allowing for inward flexure.

The method further includes a step of applying force to the sides of the insert which causes the insert to flex inwardly, a step of positioning the insert within the first and second sections of the cavity, and a step of removing force from the sides of the insert which causes the insert to flex outwardly so that the lip engages the second section of the cavity. When the insert is received in the first and second sections of the cavity, the head of the insert projects to a position above the first surface of the base.

BRIEF DESCRIPTION OF THE DRAWINGS

Aspects of an embodiment of an interchangeable foot therapy massager (hereafter, "the massager") will be described in reference to the drawings, where like numerals reflect like elements.

DETAILED DESCRIPTION

Figure 1:
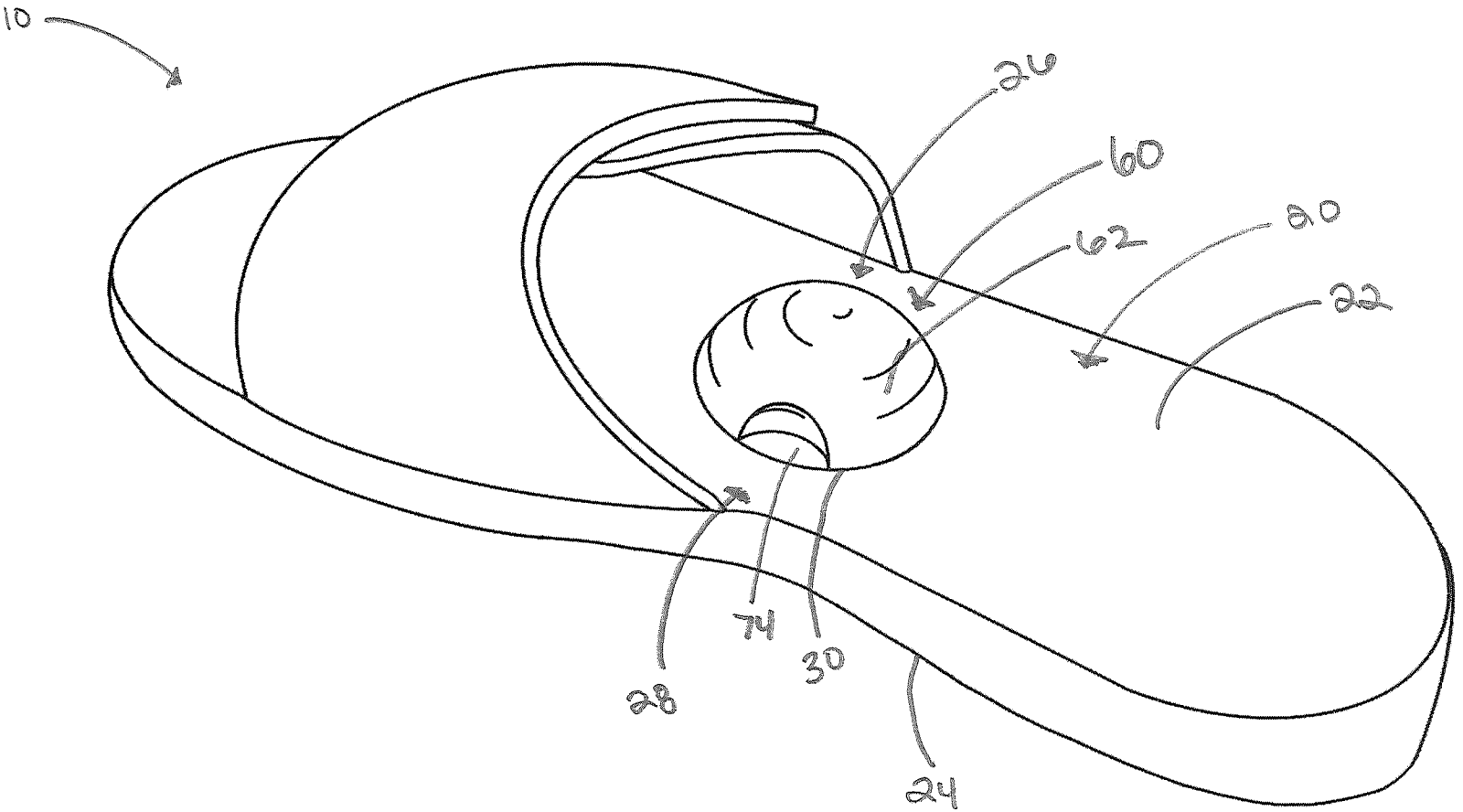
FIG. 1 is a side perspective view of the massager according to aspects of the disclosure.
Figure 2:
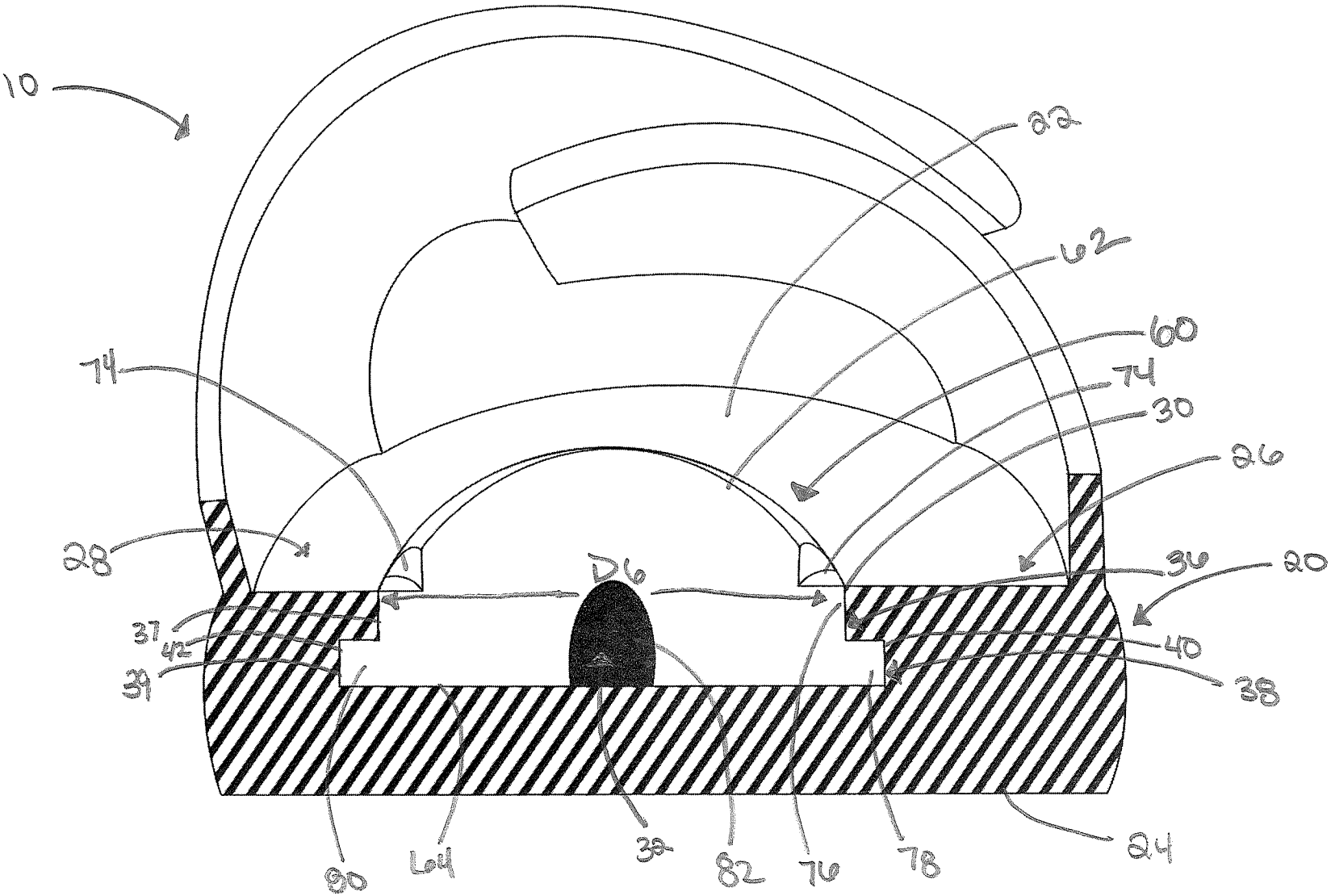
FIG. 2 is a rear cross-sectional view of the massager of FIG. 1.
Figure 3:
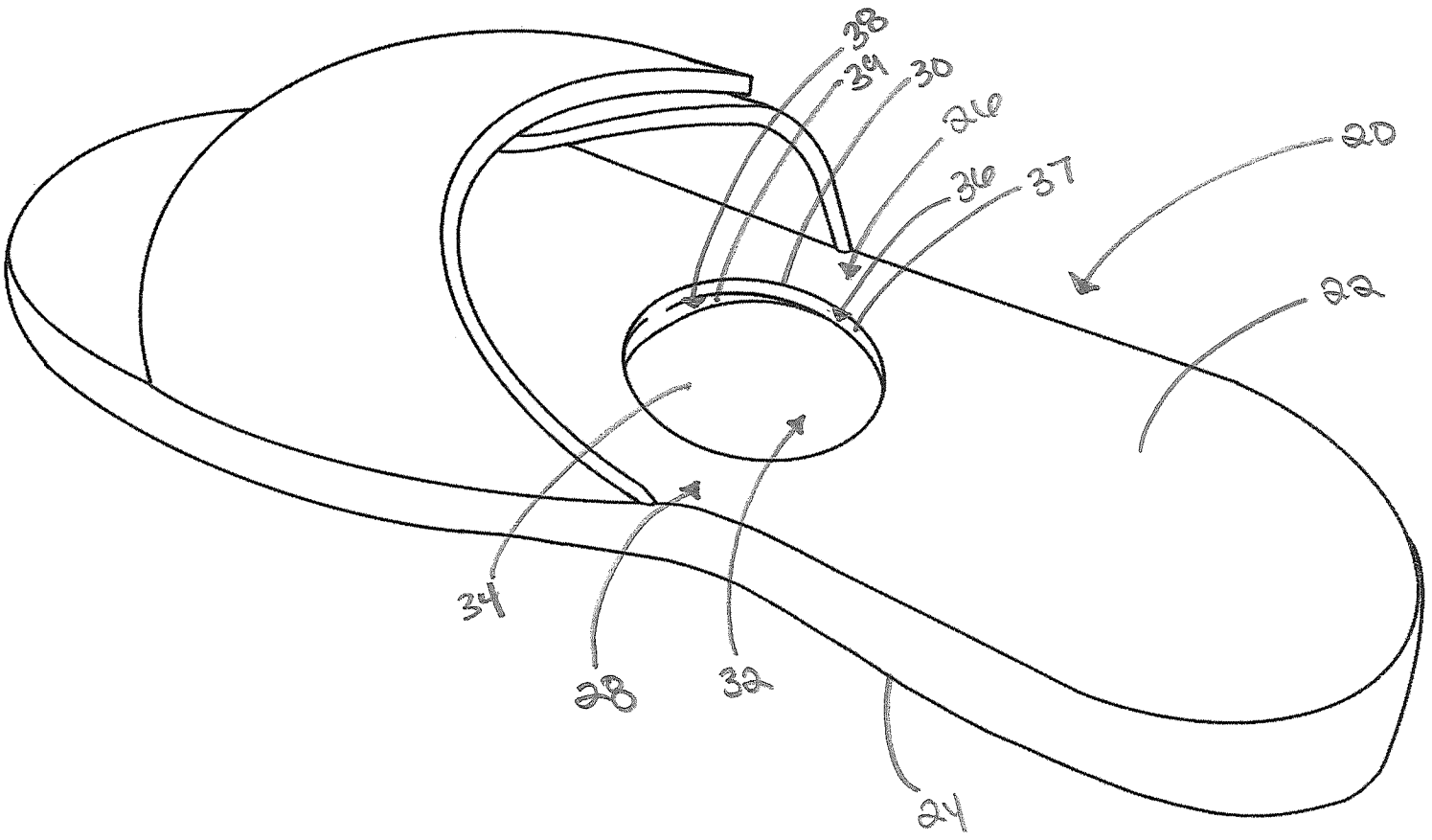
FIG. 3 is a side perspective view of a base of the massager of FIG. 1.
Figure 4:
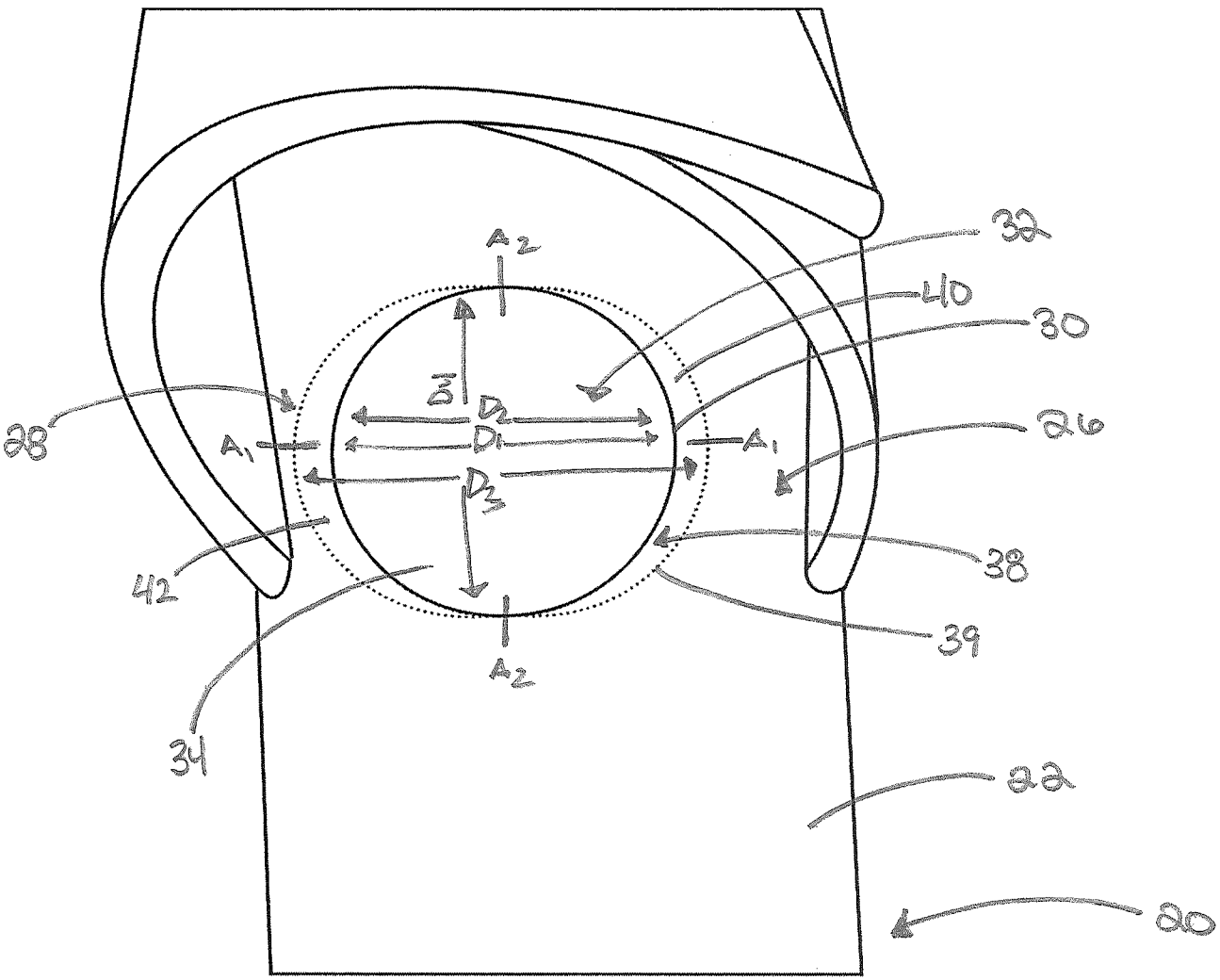
FIG. 4 is a top view of the base of the massager of FIG. 1.

An embodiment of an interchangeable foot therapy massager (hereafter, "the massager") according to aspects of the disclosure will now be described with reference to FIGS. 1-8. The massager will generally be referred to by the reference numeral 10. Various materials, methods of construction, methods of manufacture, and methods of fastening will be discussed in the context of the disclosed embodiments. Those skilled in the art will recognize known substitutes for the materials, manufacturing methods, and fastening methods, all of which are contemplated as compatible with the disclosed embodiments and are intended to be encompassed by the appended claims.

As shown in FIG. 1, a first embodiment of the massager 10 is contemplated for use on a foot of a user on any surface that is suitable for walking. The massager 10 includes a base 20 configured to be positioned between the foot of the user and a walkable surface beneath the user and an insert 60 configured to be received within the base 20 for contacting the foot of the user at a position of the foot where an injury is present and/or rehabilitation is needed. The base 20 and the insert 60 include further structures and relationships, discussed below, which allow the insert 60 to remain secure within the base 20 so as to not cause further need for rehabilitation, while also allowing the insert 60 to be quickly and easily removed and replaced with an insert 60 having different rehabilitative characteristics.

As illustrated by FIG. 1-4, the base 20 includes a substantially flat top (first) surface 22, a substantially flat bottom (second) surface 24, and a first side 26 and a second side 28. In the disclosed embodiment, the base 20 is preferably a "slide," which is an open-toed and backless form of footwear, however, it is contemplated that the base 20 can also take the form of an insole of an article of footwear such as a shoe or sneaker. A base 20 in the form of a slide reduces restriction around the foot and allows the user freedom to manipulate the foot atop the insert 60 for the most effective positioning. It is also contemplated that the base 20 could simply be a stand-alone platform having all of the same features as the disclosed embodiment, except that the stand-alone platform is not an article of footwear and cannot be used for walking.

Figure 8:
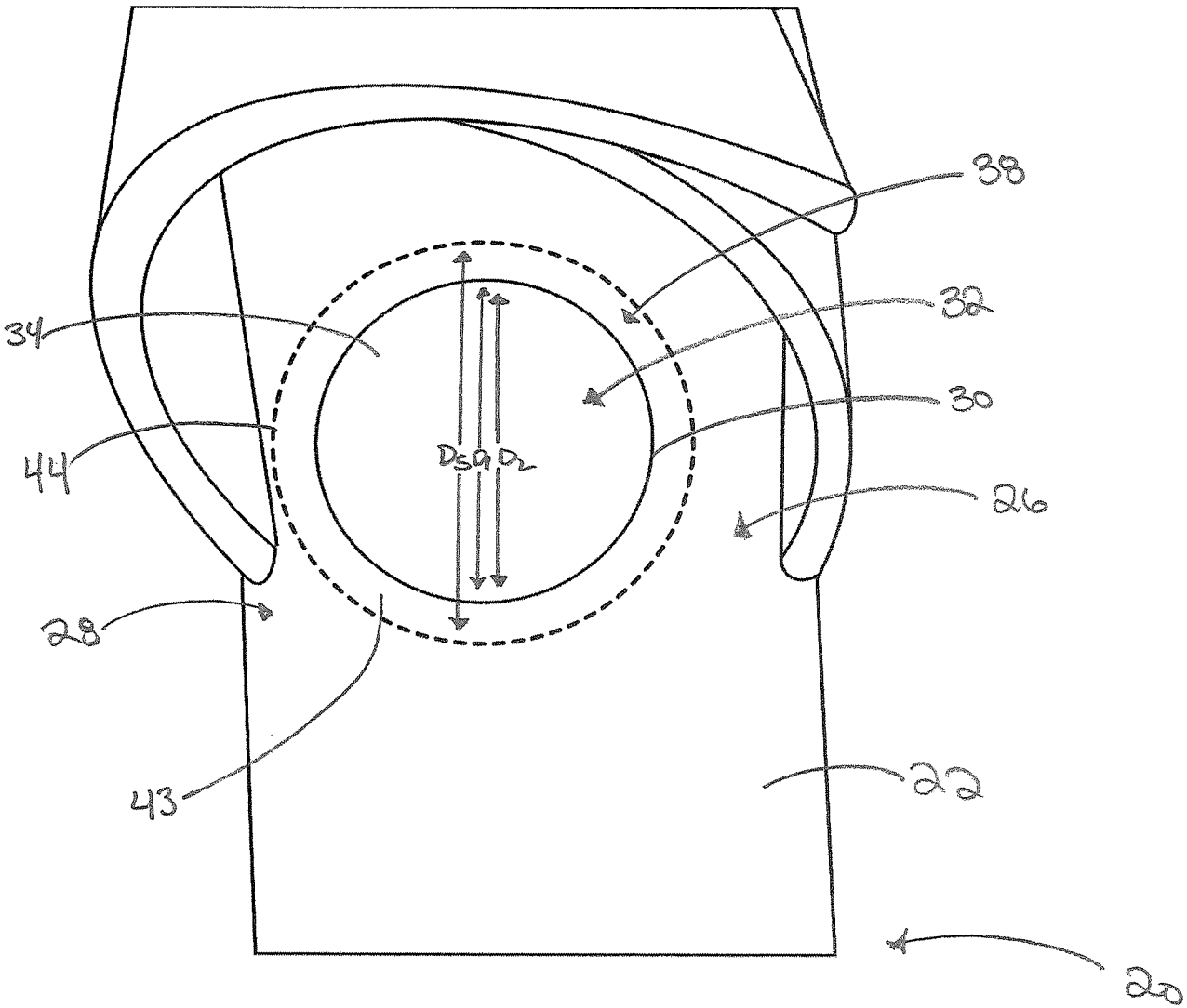
FIG. 8 is a top view of an alternative embodiment of the base of the massager of FIG. 1.

The base 20 defines an annular opening 30 having a (first) diameter $D_1$ that leads to and/or is in communication with a stepped cavity 32 for receiving the insert 60. The cavity 32 extends from the top surface 22 toward the bottom surface 24 to an inner (third) surface 34 of the base 20, but does not reach the bottom surface 24. In the disclosed embodiment, the cavity 32 extends through approximately ¼ to ¾ of the base 20, from the top surface 22 toward the bottom surface 24. However, it is contemplated that the cavity 32 may extend entirely throughout the base 20, from the top surface 22 to the bottom surface 24. The cavity 32 includes a first section 36 defined by an annular (cylindrical) sidewall 37 and a second section 38 defined by an elliptical or oval-shaped sidewall 39, each for receiving and engaging separate parts of the insert 60. The first section 36 has a (second) diameter $D_2$ that is the same as the (first) diameter $D_1$ of the annular opening 30 such that the first section 36 extends directly from and is aligned with the annular opening 30. The second section 38 has a major axis $A_1$ having a (third) diameter $D_3$ which is greater than the (second) diameter $D_2$ of the first section and a minor axis $A_2$ having a (fourth) diameter $D_4$ that is the same as the (second) diameter $D_2$ of the first section 36. The second section 38 is defined between the first section 36 and the inner surface 34 of the base 20. The major axis $A_1$ of the second section 38 extends radially beyond the first section 36 toward each side 26, 28 of the base 20 so that a first slot 40 and a second slot 42 for retaining the insert 60 are defined in the second section 38 between the top surface 22 and the inner surface 34 of the base 20. As shown in FIG. 8, it is contemplated that the second section 38 may have an annular sidewall 44, having a (fifth) diameter $D_5$ which is greater than the (second) diameter $D_2$ of the first section 36. In the configuration shown in FIG. 8, an annular slot 43 is defined between the top surface 22 of the base 20 and the inner surface 34 of the base 20 so that the lips 78, 80 no longer need to be aligned with slots 42, 44 and may be secured at multiple orientations within the slot 43. The elliptical or annular geometry of the sidewall 39 of the second section 38 creates rounded slots 40, 42, however, it is contemplated that other shapes, such as a squared or triangular (angled) slot 40, 42, may be compatible with the massager 10.

As depicted by FIGS. 1-2 and 5A-7, the insert 60 includes a hemispherical and/or dome-shaped head 62 (rehabilitation member), a substantially flat elliptical or oval-shaped bottom (support) surface 64, a first side 66 and a second side 68, and a first end 70 and a second end 72. The first and second sides 66, 68 of the insert 60 correspond to the first and second sides 26, 28 of the base 20, respectively. It is contemplated that shapes other than a dome may be used for the head 62 of the insert 60 in the disclosed massager 10. In the disclosed-embodiment, the head 62 is solid and capable of maintaining a resistance to flattening when a force is applied downwardly atop the head 62. In order to provide for effective therapy to the foot of the user, the head 62 and/or the insert 60 has a durometer (hardness/rigidity) of approximately Shore OO 97 (tennis ball) to Shore C 60 (lacrosse ball). The head 62 includes an arcuate notch 74 on each side 66, 68 to establish an arcuate finger grip for the user. The head 62 extends downwardly to an annular (cylindrical) wall 76 complimentary to the sidewall 37 of the first section 36 of the cavity 32 of the base 20. In the disclosed embodiment, the wall 76 of the insert 60 has a (sixth) diameter $D_6$ which is less than or equal to the (second) diameter $D_2$ of the first section 36 of the cavity 32 of the base 20 so that when the insert 60 is received within the first and second sections 36, 38 of the base 20, the wall 76 of insert is contiguous with the sidewall 37 of the first section 36 of the cavity 32 of the base 20 to establish a secure and stable fit within the base 20.

Referring to FIGS. 2 and 5A-5E, the first side 66 of the insert 60 includes an arcuate first lip 78 for engaging the first slot 40 on the first side 26 of the base 20 and the second side 68 of the insert 60 includes an arcuate second lip 80 for engaging the second slot 42 on the second side 28 of the base 20. Each arcuate lip 78, 80 extends radially outwardly beneath the wall 76 of the insert 60 in a stepped arrangement. Each arcuate lip 78, 80 includes an axial thickness sufficient to remain secured within the slots 40, 42 when the user's foot moves against the head 62 of the insert 60 as the user is walking. The axial thickness of each arcuate lip 78, 80 is approximately 3 to 13 millimeters, with a preferred axial thickness of approximately 6 to 10 millimeters. Each arcuate lip 78, 80 is shaped complimentary to the slots 40, 42 in the form of an end of an ellipse or oval, however, it is contemplated that other shapes, such as circular, squared (angled), or triangular (angled) lips 78, 80, may be compatible with the massager 10. In an alternative embodiment, it is contemplated that the lips 78, 80 may be omitted and the insert 60 includes threads 75 on the sidewall 76 for mating with complimentary threads (not shown) within the cavity 32 of the base 20 for a more permanent coupling between the insert 60 and the base 20.

Figures 5A, 5B, 5C, 5D, 5E:
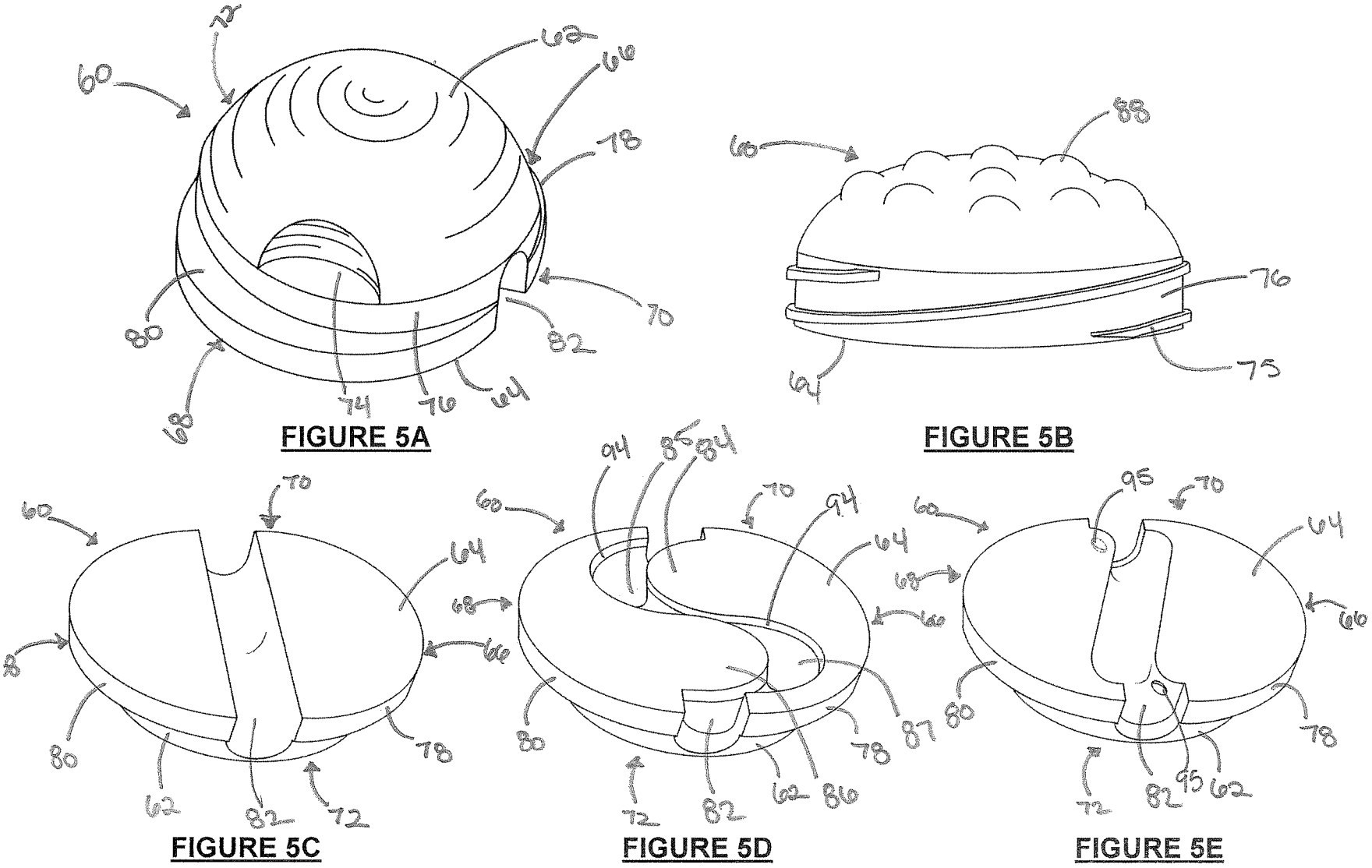
FIG. 5A is a side perspective view of an insert of the massager of FIG. 1.
FIG. 5B is a side perspective view of an alternative embodiment of the insert of the massager of FIG. 1.
FIG. 5C is a bottom perspective view of the insert of the massager of FIG. 1.
FIG. 5D is a bottom perspective view of an alternative embodiment of the insert of the massager of FIG. 1.
FIG. 5E is a bottom perspective view of an alternative embodiment of the insert of the massager of FIG. 1.

Referring to FIGS. 2, 5A, and 5C-5E, the insert 60 defines a channel 82 functioning as a space for receiving inward flexure. In the disclosed embodiment, the channel 82 is defined throughout a center of the insert 60. However, shown in FIG. 5E, the channel 82 may also extend at a diagonal across the bottom surface 64 of the insert 60. The channel 82 extends longitudinally from the first end 70 to the second end 72, and axially from a position at or beneath the head 62 through the bottom surface 64, thereby interrupting the bottom surface 64 along the center of the insert 60. In the disclosed embodiment, the channel 82 extends straight across the center of the insert 60, bisecting the bottom surface 64 of the insert 60. However, as illustrated by FIG. 5D, it is contemplated that the channel 82 may be sinuous, such that a first arcuate lobe 84 extending from the first side 66 of the insert 60 aligns with a complimentary first arcuate recess 85 of the channel 82 extending from the second side 68 of the insert 60 and second arcuate lobe 86 extending from the second side 68 of the insert 60 aligns with a complimentary second arcuate recess 87 of the channel 82 extending from the first side 66 of the insert 60. In this arrangement, the first arcuate lobe 84 is received into the first arcuate recess 85 and the second arcuate lobe 86 is received into the second arcuate recess 87 when force is applied to the sides 66, 68 of the insert 60. In this manner, a balanced surface area is maintained by the bottom surface 64 of the insert 60. Referring to FIGS. 5D and 5E, the insert 60 may also include an inner lip 94 or inner orifices 95 for engaging a holder/carrier (not shown) for the insert 60.

Figure 6B:
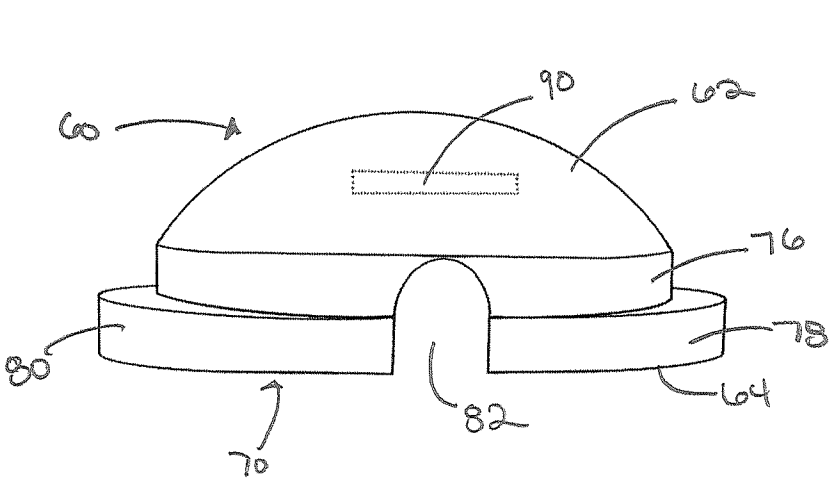
FIG. 6B is a rear perspective view of an alternative embodiment of the insert of the massager of FIG. 1.
Figure 6A:
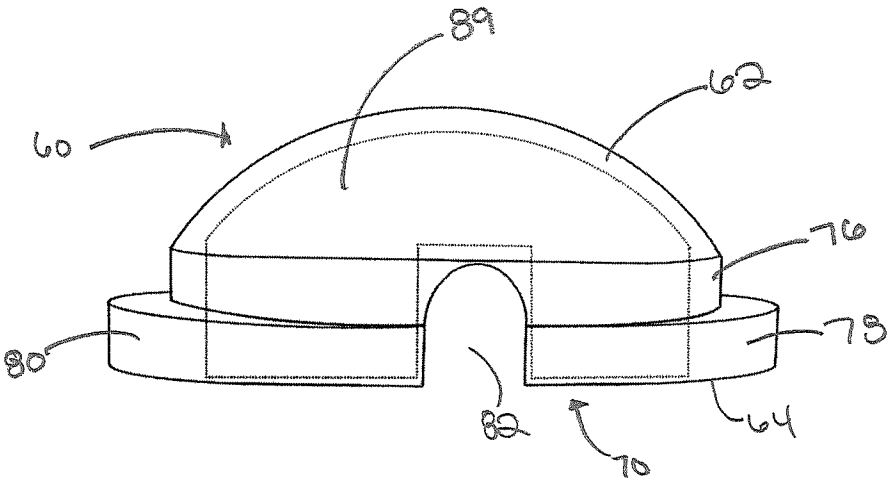
FIG. 6A is a rear perspective view of an alternative embodiment of the insert of the massager of FIG. 1.
Figure 6C:
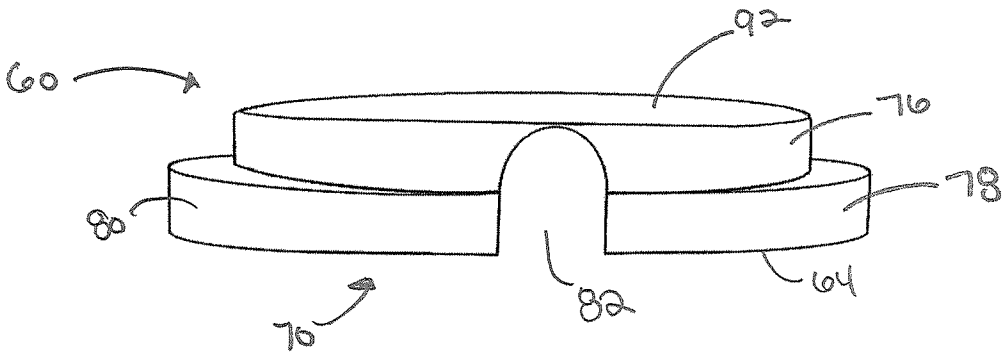
FIG. 6C is a rear perspective view of an alternative embodiment of the insert of the massager of FIG. 1.

The insert 60 is contemplated to be customizable based upon the needs of a user. The insert 60 may be configured to have different shapes, sizes, and characteristics. The insert 60 may be constructed of a flexible material such as rubber, silicone, plastic, and/or EVA foam. In the disclosed embodiment, the insert 60 has an axial height in a range of 15 to 50 millimeters, with a preferred height of approximately 30 to 40 millimeters (the head 62 preferably having an axial height of 10 to 20 millimeters). In the disclosed embodiment, the head 62 has a smooth surface, but it is contemplated that the head 62 may include a grooved surface, a dimpled surface, or a surface having raised projections or knobs 88 (see FIG. 5B). Referring to FIG. 6A, in one embodiment the head 62 defines a liquid-filled chamber 89. The liquid-filled chamber 89 may then be warmed, cooled, or frozen to the preference of the user. Referring to FIG. 6B, the head 62 may include a magnet 90 which is attracted to a complimentary magnet (not shown) included in the base 60. It is contemplated that the magnet 90 measures at approximately 400 to 800 gauss to provide additional therapeutic value to the user. In another embodiment, the insert 60 does not include the head 62 and instead includes a substantially flat top surface 92 (see FIG. 6C) which, when inserted into the base 20, is the same height as the top surface 22 of the base 20 and allows for a normal walking experience.

Figure 7:
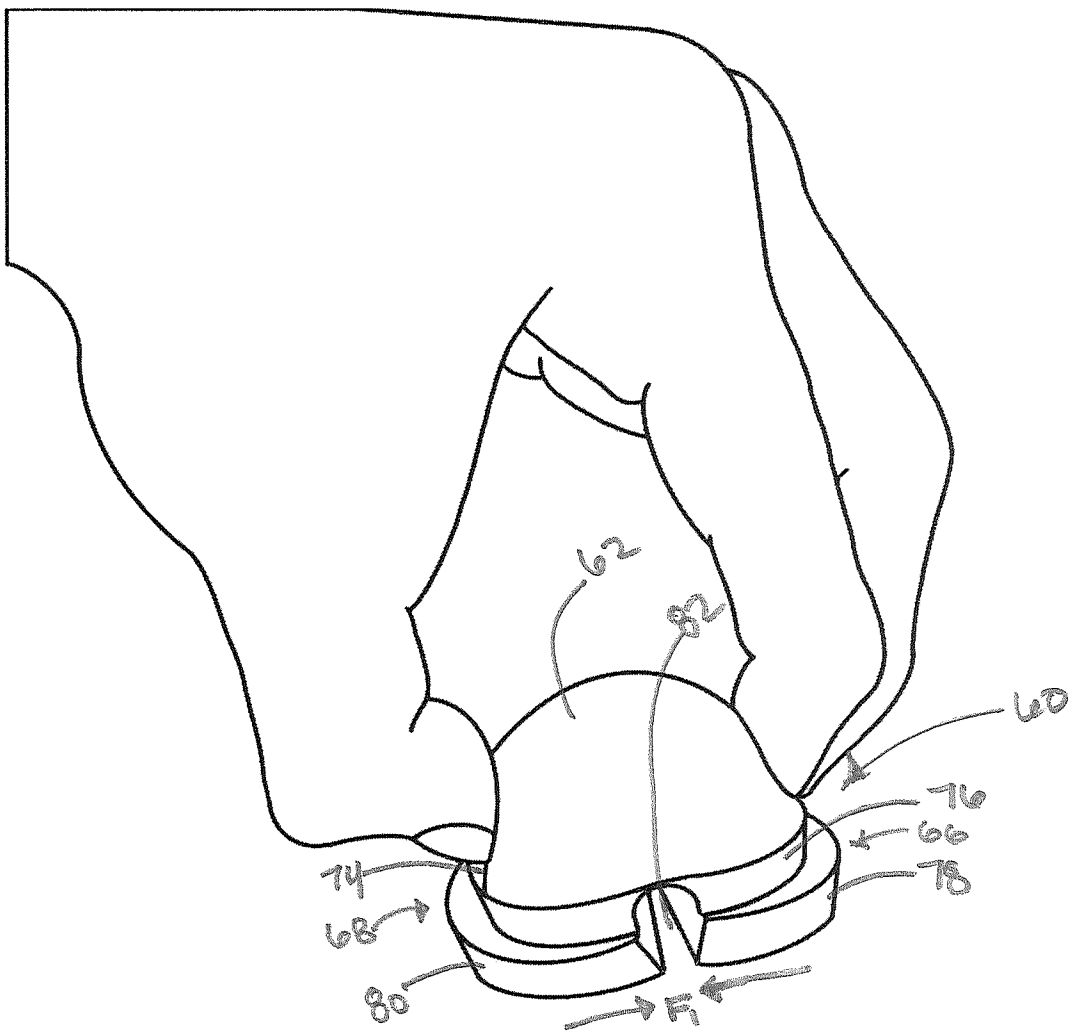
FIG. 7 is a rear perspective view of the insert of the massager of FIG. 1 shown in use by a user.

As discussed above, the massager 10 is configured so that the insert 60 can be quickly and easily inserted or removed from the base 20 so that a user can replace the insert 60 with another insert 60 or utilize the base 20 without the insert 60. As shown in FIG. 7, in use, a user selects a desired insert 60 to be used within the massager 10. The user positions a finger into each notch 74 on the insert 60 and squeezes the insert 60, applying a force $F_1$ to each side 66, 68 of the insert 60. Due to the channel 82, applying force to each side 66, 68 of the insert 60 causes the insert 60 to compress and/or flex inwardly and each side 66, 68 of the insert 60 to move toward each other until each side 66, 68 of the bottom surface 64 meets in a surface-to-surface abutment in the channel 82. When flexed inwardly, the insert 60 can be positioned within the cavity 32 of the base 20. Removing force from the sides 66, 68 of the insert 60 causes the insert 60 to expand and/or flex outwardly so that the first and second lips 78, 80 flex outwardly into the respective first and second slots 40, 42 and the annular wall 76 presses against the annular sidewall 37 of the base 20.

While an embodiment of the disclosed interchangeable foot therapy massager 10 has been set forth for purposes of illustration, the foregoing description should not be deemed a limitation of the invention. Accordingly, various modifications, adaptations and alternatives may occur to one skilled in the art without departing from the spirit of the disclosure and the scope of the claimed coverage.

What is claimed:

1. An interchangeable foot therapy massager configured for use on a walkable surface comprising:

a base configured to be positioned between a foot of a user and a walkable surface beneath the user, said base including a first surface and a second surface and defining a cavity extending from the first surface toward the second surface, said cavity including a first section having a first diameter and second section having a second diameter greater than the first diameter;

an insert configured to be received within the first and second sections of the cavity and positioned between the foot of the user and the walkable surface, said insert including a head extending to a support surface and configured to contact the foot of the user, a lip configured to engage the second section of the cavity, and said insert defining a space configured to allow inward flexure; and wherein, applying force to the insert causes the insert to flex inwardly, removing force from the insert causes the insert to flex outwardly so that the lip engages the second section of the cavity when the insert is received within the first and second sections of the cavity, and said head projects to a position above the first surface of the base when the insert is received within the first and second sections of the cavity.

2. The interchangeable foot therapy massager of claim 1, wherein the head is dome-shaped and extends down to a flat support surface.

3. The interchangeable foot therapy massager of claim 1, wherein the head is dome-shaped and extends down to a cylindrical sidewall oriented between the head and the lip.

4. The interchangeable foot therapy massager of claim 1, wherein the insert is constructed from a flexible material selected from a group consisting of rubber, silicone, plastic, or EVA foam.

5. The interchangeable foot therapy massager of claim 1, wherein the head defines a liquid-filled chamber.

6. An interchangeable foot therapy massager configured for use on a walkable surface comprising:

a base configured to be positioned between a foot of a user and a walkable surface beneath the user, said base including a first surface and a second surface and defining a cavity including a first fastener and extending from the first surface toward the second surface;

an insert configured to be received within the cavity and positioned between the foot of the user and the walkable surface, said insert including a head extending to a support surface and configured to contact the foot of the user a second fastener complimentary to the first fastener configured to couple to the cavity, and said insert defining a space configured to allow inward flexure; and wherein, the first fastener of the cavity couples to the second fastener of the insert when the insert is received within the cavity and said head projects to a position above the first surface of the base when the insert is received within the first and second sections of the cavity.

7. The interchangeable foot therapy massager of claim 6, wherein said cavity includes a first section having a first diameter and second section having a second diameter greater than the first diameter.

8. The interchangeable foot therapy massager of claim 7, wherein the insert includes a lip configured to engage the second section of the cavity.

9. The interchangeable foot therapy massager of claim 7, wherein the first and second fasteners are threads configured to be threaded together when the insert is received within the cavity.

10. The interchangeable foot therapy massager of claim 7, wherein the first and second fasteners are magnets included within the base and the insert configured for securing the insert within the cavity.

11. A method of making an interchangeable foot therapy massager configured for use on a walkable surface comprising:

providing a base configured to be positioned between a foot of a user and a walkable surface beneath the user, said base including a first surface and a second surface;

defining a cavity extending from the first surface of the base toward the second surface of the base, said cavity including a first section having a first diameter and second section having a second diameter greater than the first diameter;

providing an insert configured to be received within the first and second sections of the cavity and positioned between the foot of the user and the walkable surface, said insert including a head extending to a support surface and configured to contact the foot of the user, a lip configured to engage the second section of the cavity, and defining a space configured to allow inward flexure;

applying force to the insert causing the insert to flex inwardly;

positioning the insert within the first and second sections of the cavity;

removing force from the insert causing the insert to flex outwardly so that the lip engages the second section of the cavity when the insert is received within the first and second sections of the cavity; and wherein, said head projects to a position above the first surface of the base when the insert is received within the first and second sections of the cavity.

12. The method of making an interchangeable foot therapy massager of claim 11, wherein the step of providing an insert includes the space defined by the insert extending between a first end and a second end of the insert.

13. The method of making an interchangeable foot therapy massager of claim 11, wherein the step of providing an insert includes the space defined by the insert extending between the head of the insert and the support surface of the insert.

14. The method of making an interchangeable foot therapy massager of claim 11, wherein the step of providing an insert includes the space defined by the insert interrupting the support surface of the insert.

15. The interchangeable foot therapy massager of claim 1, wherein the space defined by the insert extends between a first end of the insert and a second end of the insert.

16. The interchangeable foot therapy massager of claim 1, wherein the space defined by the insert extends between the head of the insert and the support surface of the insert.

17. The interchangeable foot therapy massager of claim 1, wherein the space defined by the insert interrupts the support surface of the insert.

18. The interchangeable foot therapy massager of claim 6, wherein the space defined by the insert extends between a first end of the insert and a second end of the insert.

19. The interchangeable foot therapy massager of claim 6, wherein the space defined by the insert extends between the head of the insert and the support surface of the insert.

20. The interchangeable foot therapy massager of claim 6, wherein the space defined by the insert interrupts the support surface of the insert.

* * * * *